US006059028A

United States Patent [19]

Kincheloe et al.

[11] Patent Number: 6,059,028

[45] **Date of Patent: *May 9, 2000**

[54] CONTINUOUSLY OPERATING LIQUID-COOLED PANEL

[75] Inventors: David P. Kincheloe; Richard J. Manasek, both of Greenwood; Richard W. McVicker, Indianapolis, all of Ind.

[73] Assignee: Amerifab, Inc., Indianapolis, Ind.

[ * ] Notice: This patent issued on a continued prosecution application filed under 37 CFR 1.53(d), and is subject to the twenty year patent term provisions of 35 U.S.C. 154(a)(2).

[21] Appl. No.: 09/027,857

[22] Filed: Feb. 23, 1998

Related U.S. Application Data

[60] Provisional application No. 60/039,922, Mar. 7, 1997.

[51] Int. Cl.[7] ..... F28F 27/02

[52] U.S. Cl. ..... 165/297; 165/101; 165/169

[58] Field of Search ..... 165/101, 168, 165/169, 297

[56] References Cited

U.S. PATENT DOCUMENTS

| | | | |
|---|---|---|---|
| 2,304,788 | 12/1942 | Bailey | 165/168 X |
| 3,693,708 | 9/1972 | Andoniev et al. | 165/101 |
| 3,704,747 | 12/1972 | Andoniev et al. | 165/101 |
| 3,829,595 | 8/1974 | Nanjyo et al. | 165/169 X |
| 5,601,141 | 2/1997 | Gordon et al. | 165/168 X |

*Primary Examiner*—Leonard Leo
*Attorney, Agent, or Firm*—Dougherty & Associates

[57] ABSTRACT

The present invention is a dual section liquid-cooled panel that lines a portion of the interior surface of a metallurgical furnace. The invented panel has a primary section disposed proximate to the center of the furnace and a secondary or back-up section adjacent the primary section. A three-way valve is controls the flow of fluid to the operating section of the panel. Initially, the primary section is operational and the valve is set to permit the flow of fluid to the primary section. If the primary section suffers structural damage, the valve can be used to re-direct the cooling fluid to the secondary section of the invented panel and the secondary section becomes operational until regular maintenance is scheduled to occur. Also disclosed is a method for repairing a damaged dual section liquid-cooled panel.

17 Claims, 4 Drawing Sheets

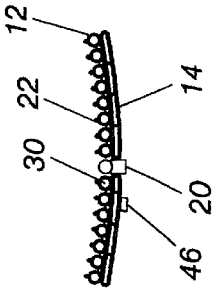
Fig.6
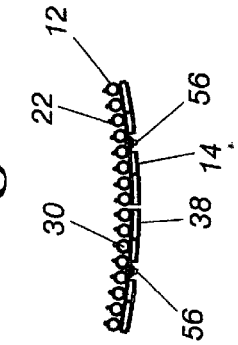
Fig.5
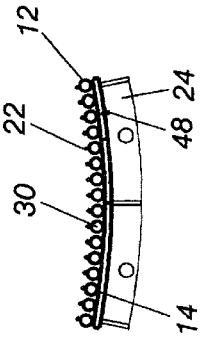
Fig.4
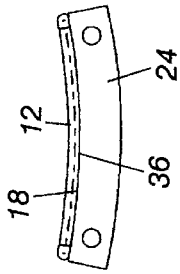
Fig.2
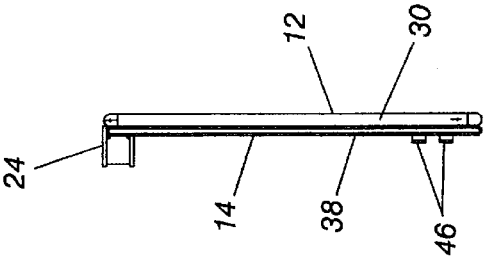
Fig.8
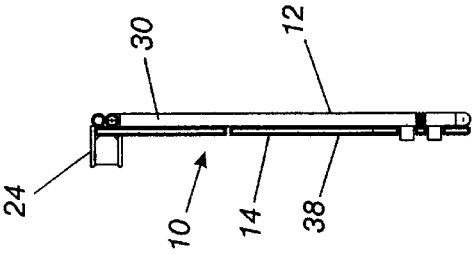
Fig.7
Fig.3
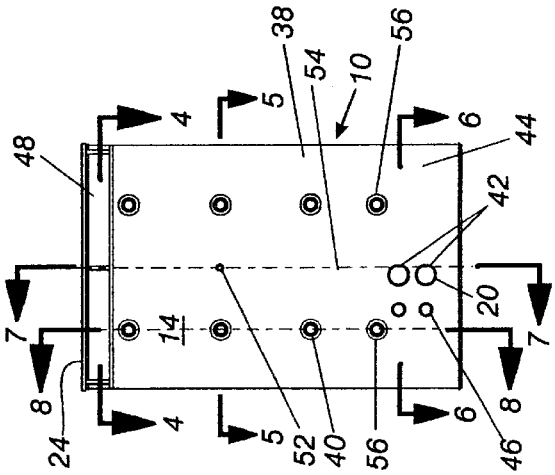
Fig.1

CONTINUOUSLY OPERATING LIQUID-COOLED PANEL

CROSS-REFERENCE TO RELATED APPLICATIONS

This application claims the benefit of U.S. Provisional Application Ser. No. 60/039,922 filed Mar. 7, 1997.

FIELD OF THE INVENTION

The present invention relates generally to a method and to an apparatus for extending the operational life of metallurgical furnaces, including metal smelting and refining furnaces. Yore particularly, the invention relates to dual section water-cooled panels mountable to the walls, roof or duct work of a furnace that enable a steel maker to continue operating a furnace even after one of the panel sections leaks or is otherwise damaged.

BACKGROUND

Steel is made by melting and refining steel scrap in an electric arc furnace (EAF). Today, the EAF is considered by those skilled in the art of steel production to be the single most critical apparatus in a steel mill or foundry. Consequently, it is of vital importance that the EAF remain operational for as long as possible.

Structural damage caused during the charging process is a persistent problem that affects the operation of an EAF. Because scrap has a lower density than molten steel, the EAF must have sufficient volume to accommodate the scrap and still produce the desired amount of steel. As the steel melts it forms a hearth or smelting area in the lower portion of the furnace. As the volume of steel in the furnace is reduced, however, the free volume in the EAF increases. The portion of the furnace above the hearth or smelting area must be protected against the high internal temperatures of the furnace. The vessel wall, cover or roof and duct work are particularly at risk from massive thermal, chemical, and mechanical stresses caused by charging the steel. Such stresses greatly limit the operational life of the furnace.

Historically, the EAF was generally designed and fabricated as a welded steel structure which was protected against the high temperatures of the furnace by a refractory lining. In the late 1970's and early 1980's, the steel industry began to combat such stresses by replacing expensive refractory brick with water-cooled roof panels and water-cooled side-wall panels located in portions of the furnace vessel above the smelting area. Water-cooled panels have also been used to line furnace duct work. Existing water-cooled panels are made both with various grades and types of plates and pipes.

Using water-cooled panels has reduced refractory costs and has also enabled steel makers to operate each furnace for a greater number of heats. Furthermore, water-cooled equipment has enabled the furnaces to operate at increased levels of power. Consequently, production has increased and furnace availability has become increasingly more important.

Although water-cooled panels last longer than the brick refractory they replaced, the panels have serious problems with wear and are subject to damage. It is now common in the steel making industry to expect a critical breakdown of one or more of the panels within a few months of the furnace going on line.

When a water-cooled panel is damaged and water begins to leak into the interior chamber of the EAF, serious operational issues are encountered. When such a breakdown occurs, the damaged water-cooled panels must be replaced as soon as possible. To make this repair, the EAF must be taken out of production for unscheduled maintenance. This unscheduled downtime can have serious repercussions throughout the steel mill. For example, when the furnace is down, no molten steel is being produced by the steel mill which can cost as much as five thousand dollars per minute for the production of certain types of steel. Such interruptions also decrease production and significantly increase operating expenses. Also, making unscheduled repairs to the furnace panels constitutes a considerable percentage of maintenance expenses.

A need, therefore, exists for an improved water-cooled furnace panel that can remain operable longer than existing comparable panels and that can remain operable, despite some structural damage, until scheduled maintenance occurs.

SUMMARY OF THE INVENTION

The present invention is an apparatus and method for extending the operational life of metallurgical furnaces, including metal smelting and refining furnaces, and for maintaining such furnaces in an operating condition at least until regular maintenance is scheduled to occur, thereby avoiding costly downtime. Although the invented apparatus can be used in conjunction with most metallurgical furnaces, the invention will be described herein with regard to electric arc steel making furnaces.

The invented apparatus is a continuously operating liquid-cooled panel for an EAF having two sections that each comprise a separate cooling system. Consequently, the present invention allows a steel maker to continue operating a furnace, even after a panel is damaged, at least until the steel maker is scheduled to shut down the mill for normal maintenance. The dual section water-cooled panels are used for portions of the walls, roof or cover, duct work, dust evacuation system components, and any other component requiring heat removal.

The dual section water-cooled panel includes a primary section facing the furnace interior and a secondary or back-up section. The primary section has an inner surface proximate to the molten steel and preferably incorporates plates, pipes or apparatus for spray-cooling. The primary section can have slag bars, cups, pins, or any other type of slag retention device, in any desired pattern or layout, affixed to its inner surface.

A secondary section is mounted adjacent the outer surface of the primary section. The secondary section can be either affixed to the primary section or may be independent of the primary section in which case it would be fixed to the furnace. The secondary section preferably incorporates pipes, plates, tubes, angles, channels, or any other shapes, or it may be configured for spray cooling with water, air or some other type of liquid or gas such as steam and argon. The secondary section can be made out of any desired material, such as steel, copper, chromium molybdenum alloy, stainless steel and aluminum bronze.

In operation, the primary section initially has a sufficient amount of water flowing through it to achieve the intended heat reduction. While the primary section is fully operating, the secondary section will have a variable amount of water flowing through it depending upon the requirements of the operation. Typically, when the secondary panel is not needed, the operator will maintain only a minimal flow of water through the secondary panel to conserve water.

It is not until the primary section is damaged that water flow is increased through the secondary section. As a result, very little additional water is required with the present invention than with presently available water-cooled panels. Finally, when the secondary section is in full operation, the present invention allows the flow of water into the primary section to be eliminated to avoid serious operational issues, such as water flowing into the molten bath.

Since the invented panel has both a primary section and a secondary section, the operating primary section remain operational despite sustaining damage, such as by a direct arc hit, by an oxygen wash, and/or by steel or mechanical damage. In the past, furnace operators were tempted to try to continue operating a damaged furnace until after they tapped the heat in the furnace. With the present invention, furnace operators can instead quickly divert the flow of water from the primary section to the secondary section and thereby continue operating the furnace. The primary section, even when damaged, will aid in protecting the face of the secondary section nearer the molten bath from structural damage.

In the event of a failure in the primary section, the cooling water is transferred from the primary section to the secondary section. That is, flow of water to the primary section is stopped and flow through the secondary section is brought to full operation. The process of diverting the flow of water from the primary section to the secondary section can be accomplished by manual transfer hoses having separate water feeds or, preferably, by use of three-way valves that are controlled by an automatic sensor.

Although the primary section becomes somewhat hotter or maybe further damaged when it is not operating, the furnace does not need to be shut down. Consequently, the furnace can continue normal operations without any significant furnace downtime. The furnace can, therefore, remain functional and repairs to the primary section need not be made until the next regularly scheduled maintenance period. Even after the primary section has failed, the secondary section allows the furnace to be operated until the next regularly scheduled furnace shut down period. In some mills, this period can be as long as three to four weeks. As a result, the present invention virtually eliminates the need to shut down the furnace to make unscheduled repairs to the sidewalls or roof of the furnace.

The invented dual section water-cooled panel provides a safe and low cost way to reduce downtime that plagues existing furnaces. The invented water-cooled panel allows a furnace to remain in an operable condition thereby minimizing downtime associated with unscheduled maintenance. The invented panel also prevents large quantities of water from discharging into the furnace and prevents steam from building up in the panel which would further damage the panel.

The invented dual section panel also eliminates the need for stiffener bars which are welded to the back of a normal water-cooled panel or duct. In the present invention, the secondary section actually becomes the stiffener or support for the primary section. The net result is that the invented dual section panel is only about one-half (½) to one (1) inch thicker than currently existing water-cooled panels. The invented panel, therefore, does not have a significantly greater thickness than existing panels. As a result, furnace volume is not dramatically reduced by incorporating the invented panels in an EAF.

The invention also comprehends a method for extending the operational life of an EAF using a dual section water-cooled panel system. The invented method includes first shutting down the EAF during a scheduled repair period. The primary section is then disconnected from engagement with the fluid introducing and removing means and removed from its position adjacent the secondary section. Preferably, the water cooled equipment is then returned to the manufacturer. Next, the primary section is repaired and/or critical components are replaced depending upon the severity of damage sustained by the primary section. Finally, the primary section is repositioned adjacent the secondary section and is attached to the fluid introducing and removing means.

Objects of the Invention

Accordingly, a principal object of the present invention is to provide an improved cooling system to protect an electric arc furnace from failure due to chemical, thermal, and mechanical stresses.

A further object of the invention is to provide a dual section water-cooled panel having a primary cooling section and a secondary or back-up cooling section which operates only in the event the primary cooling system is damaged or leaks.

Another object of the invention is to provide an improved cooling panel that enables a furnace to be operated without maintenance until regularly scheduled maintenance occurs.

Another object of the invention is to provide an improved cooling panel that eliminates the need to anticipate the premature replacement of water cooled equipment due to equipment wear.

Another object of the invention is to provide an improved method for extending the operational duration of a furnace by repairing or replacing only a portion of the water-cooled equipment at the end of the scheduled life cycle of the entire water cooled equipment.

BRIEF DESCRIPTION OF THE DRAWINGS

The foregoing and other objects will become more readily apparent by referring to the following detailed description and the appended drawings in which:

FIG. 1 is a rear elevational view of a continuously operating liquid-cooled panel according to the invention;

FIG. 2 is a plan view of the liquid-cooled panel of FIG. 1;

FIG. 3 is a right end view of the liquid-cooled panel of FIG. 1;

FIG. 4 is a cross-sectional plan view of the liquid-cooled panel of FIG. 1 taken along line 4—4;

FIG. 5 is a cross-sectional plan view of the liquid-cooled panel of FIG. 1 taken along line 5—5;

FIG. 6 is a cross-sectional plan view of the liquid-cooled panel of FIG. 1 taken along line 6—6;

FIG. 7 is a cross-sectional side view of the liquid-cooled panel of FIG. 1 taken along line 7—7;

FIG. 8 is a cross-sectional side view of the liquid-cooled panel of FIG. 1 taken along line 8—8;

DETAILED DESCRIPTION

Figure 12:
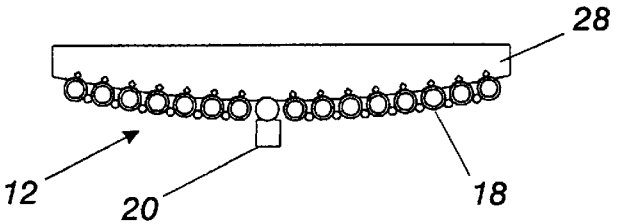
FIG. 12 is a cross-sectional plan view of the primary section of FIG. 9, including an assembly jig, taken along line 12—12.
Figure 11:
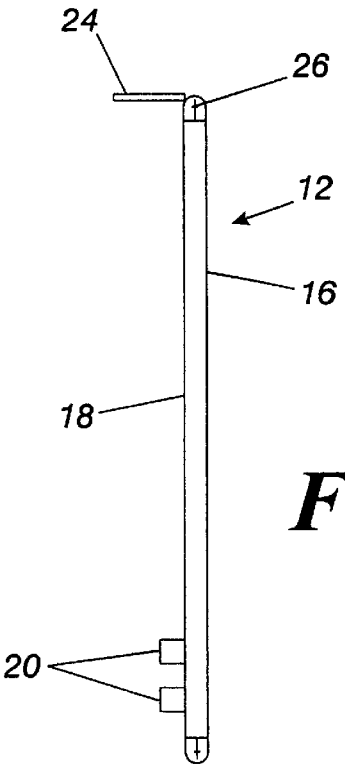
FIG. 11 is a left hand end view of the primary section of FIG. 9.
Figure 10:
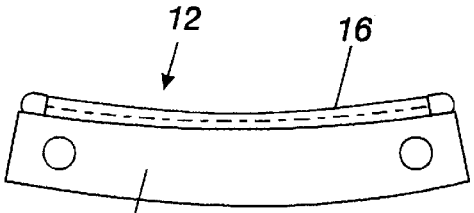
FIG. 10 is a plan view of the primary section of FIG. 9.
Figure 9:
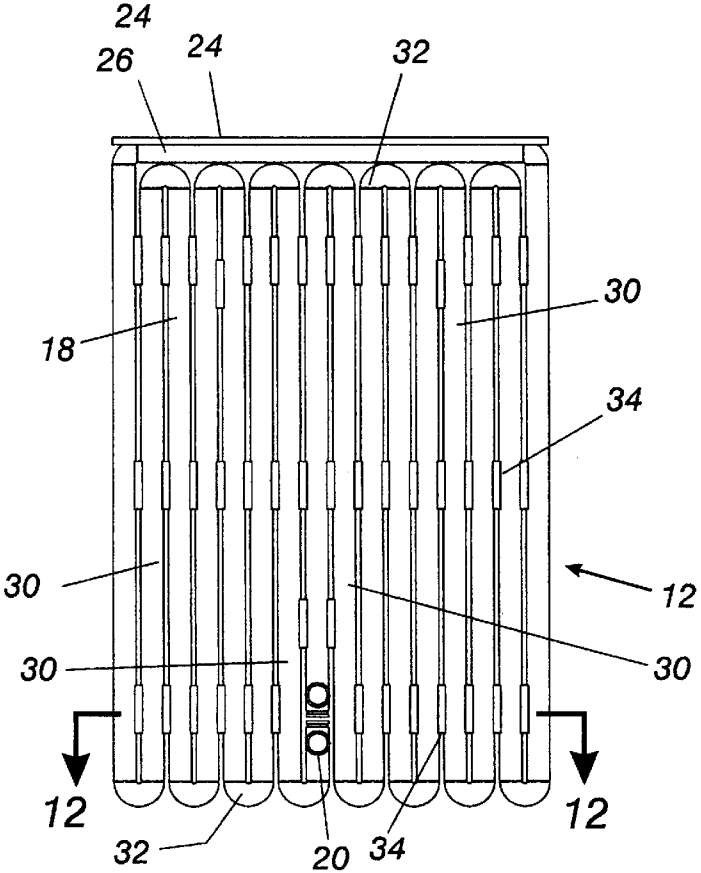
FIG. 9 is a front elevational view of a primary section of the continuously operating liquid-cooled panel of FIG. 1.
Figure 17:
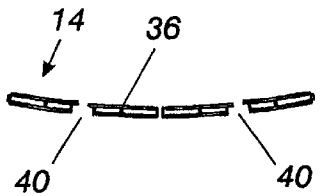
FIG. 17 is a cross-sectional plan view of the secondary section of FIG. 13 taken along line 17—17.
Figure 16:
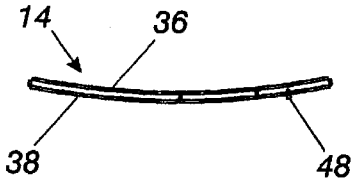
FIG. 16 is a cross-sectional plan view of the secondary section of FIG. 13 taken along line 16—16.
Figure 14:
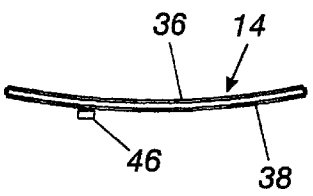
FIG. 14 is a plan view of the secondary section of FIG. 13.
Figure 15:
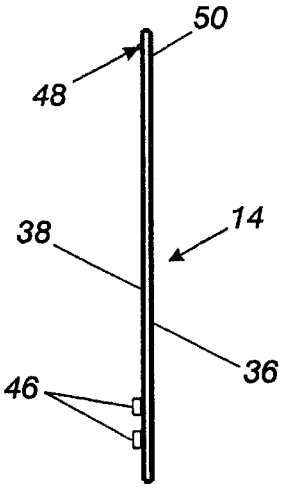
FIG. 15 is a right end view of the secondary section of FIG. 13.
Figure 19:
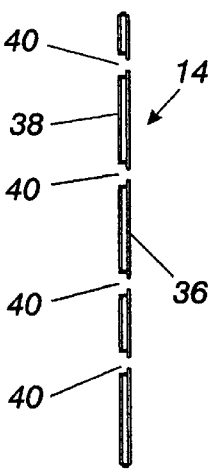
FIG. 19 is a vertical cross-sectional view of the secondary section of FIG. 13 taken along line 19—19.
Figure 18:
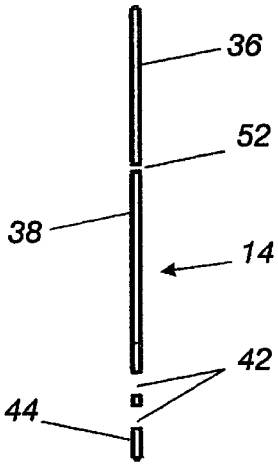
FIG. 18 is a vertical cross-sectional view of the secondary section of FIG. 13 taken along line 18—18.
Figure 13:
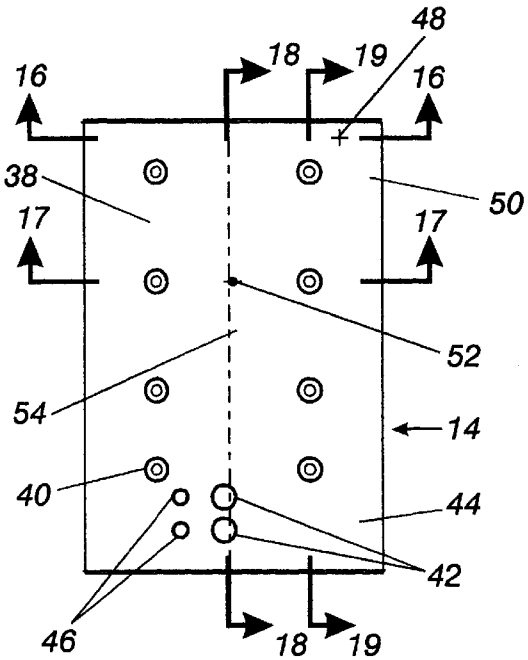
FIG. 13 is a rear elevational view of a secondary section of the continuously operating liquid-cooled panel of FIG. 1.

Referring now to the drawings, the invented fluid-cooled panel 10 includes two sections: a primary or inner section 12 and a secondary or back-up section 14. The primary section 12 includes structural components such as pipes, plates or spray-cooled panels. The secondary section 14 is mounted adjacent the outer surface 18 of the primary section 12. The secondary section 14 also includes structural components such as pipes, plates, tubes, angles, channels, or any other shapes, or it may be configured for interior spray cooling with water, air or some other type of liquid or gas, such as steam or argon.

As shown in FIGS. 1–8, a preferred embodiment of the invented water-cooled panel 10 is an assembly of a pipe type primary section 12 and a hollow plate type secondary section 14. The primary and secondary sections 12, 14 can be made of known materials having desirable characteristics of heat transfer capability, structural integrity, shock resistance and repairability. In addition, a layer of castable refractory material can be sandwiched between the two sections 12, 14 or can be positioned in the interstitial spaces between the pipes of the primary section 12. The invented panel 10 is mounted in the furnace shell or roof structure in a manner similar to existing water-cooled panels. This also holds true if the panel 10 is used in a furnace evacuation duct.

Initially, cooling water will flow primarily through the primary section 12. At the same time, some cooling water, however, will flow through the secondary section 14. It is possible to have no flow as water through the secondary section while the primary section is operational. The invented panel 10 can remain operational despite some structural damage to the primary section 12 caused by a direct arc hit, oxygen/steel wash or scrap puncturing the working surface 16. Once damage has occurred to the primary section 12, the flow of water is quickly diverted from the primary section 12 to the secondary section 14, thereby allowing continuous operation of the furnace.

In the event of a failure of the primary section 12, the flow of cooling water is diverted from the primary section 12 into the secondary section 14. That is, flow of water to the primary section 12 is stopped and flow through the secondary section 14 is brought to an effective level of operation to remove heat from the furnace. The process of diverting the flow of water from the primary section 12 to the secondary section 14 can be accomplished by manual transfer hoses having separate water feeds, by opening a secondary set of valves, or, preferably, by use of a three-way valve controlled by automatic sensors preferably embedded in the primary section.

A furnace incorporating the invented panels 10 can, therefore, remain functional and repairs to the primary section 12 ordinarily will not need to be made until the next regularly scheduled maintenance period.

As shown in FIGS. 9–12, the primary section 12 has an inner surface or face 16 that is exposed to the furnace interior chamber and an outer surface or face 18 that is proximate to the secondary section 14.

In a preferred embodiment, connectors 20 are positioned on the primary section 12 to secure the two sections together. The connectors 20 also provide a means for introducing and/or removing fluid (liquid or gas) to the primary section 12 from a source outside the secondary section 14. A flange 24 is attached to an upper region 26 of the primary section 12 for connecting the invented panel 10 to a furnace shell. An assembly jig 28 is securable to the inner surface 16 of the primary section 12 for assembly purposes.

Slag adhesion devices 22 can be welded to the inner surface or face 16 of the primary section 12 to assist in the formation and retention of a slag layer adjacent the inner surface 16. Vertical rods are depicted in FIGS. 4–6, but suitable devices include horizontal bars, vees, cups, pins, or any other type of slag retention device, in any desired pattern or layout.

As previously discussed, the fluid-cooled panel 10 is a pipe type embodiment having multiple axially arranged pipes 30. U-shaped elbows 32 connect adjacent pipes 30 together to form a continuous pipe system. Spacers 34 may be provided between adjacent pipes 30 to provide structural integrity to the primary panel 12.

As shown in FIGS. 13–19, the secondary section 14 has an inner surface 36 that is adjacent to the outer surface 18 of the primary section 12 and has an outer surface 38 that forms the rear exterior of the invented panel 10.

Connection apertures 40 are symmetrically formed in the secondary section 14. The apertures 40 allow the secondary section 14 to be secured to the primary section 12. Bolts or welded studs 56 extend through the apertures 40 in the secondary section 14 and are secured to the primary section 12.

In a preferred embodiment of the fluid-cooled panel 10 has a plate type secondary section 14. A pair of apertures 42 are formed in a lower region 44 of the secondary section 14. The apertures 42 correspond to the connectors 20 extending from the primary section 12. When the invented panel 10 is assembled the connectors 20 extend through the apertures 42, and the primary section 12 is thereby secured to the secondary section 14.

Half couplings 46 are positioned in the lower region 44 of the secondary section 14 adjacent the apertures 42. Half couplings 46 provide liquid or gas flow connections to the secondary section 14. Half coupling 48 is positioned in an upper region 50 of the secondary section 14 for a bleed line that reduces any air entrapment in the secondary section 14. Full coupling 52 is positioned in a central region 54 of the secondary section 14 for the positioning of a thermocouple that provides a temperature reading between the primary section 12 and secondary section 14. The thermocouple acts as a temperature sensor to detect failure of the primary section and can be coupled to a desired flow control device to divert coolant from the primary section 12 to the secondary section 14.

Figure 20:
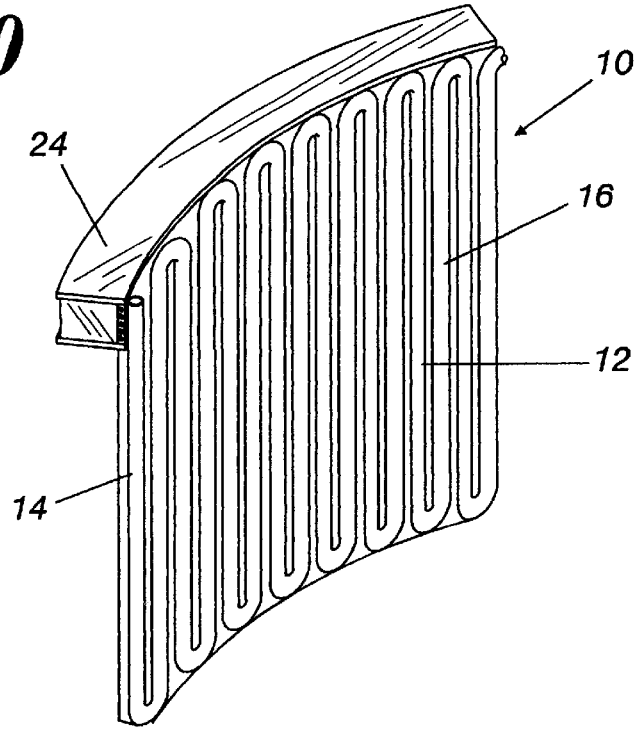
FIG. 20 is a perspective view of the invented panel.

FIG. 20 is a perspective view of an alternative panel with alternative fluid connector positions, showing relative locations of the primary and secondary sections in a furnace wall panel.

Figure 21:
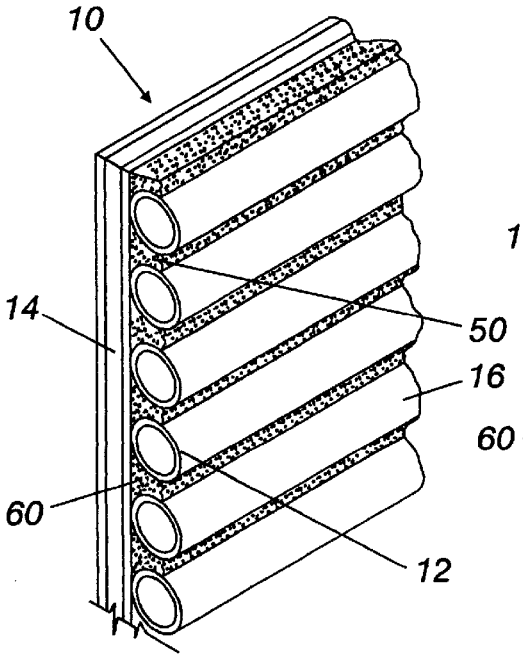
FIG. 21 is a partial perspective view of a preferred embodiment of the invented panel.

FIG. 21 is a partial perspective view of a preferred embodiment of the invented panel 10. Castable refractory material 58 is positioned in the interstitial spaces 60 between the pipes 30 of the primary section 12. Thus, the layer of refractory material 58 helps maintain the structural integrity of the primary section 12. Finally, the refractory material 58 controls and limits removal of heat from the interior of the furnace.

Figure 22:
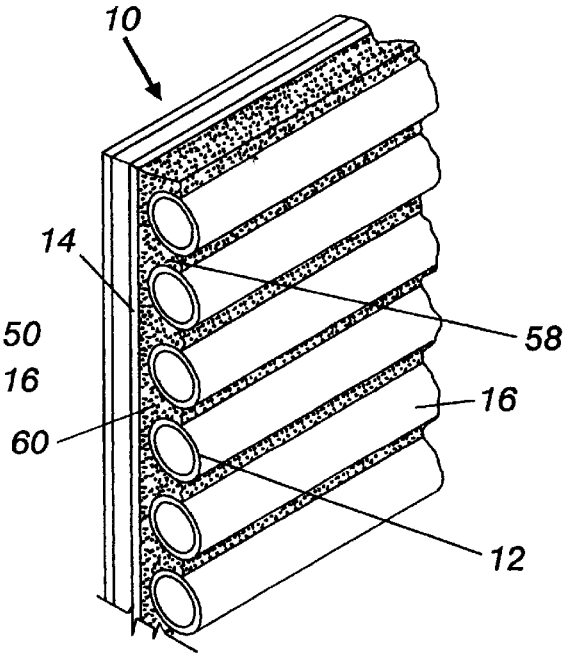
FIG. 22 is a partial perspective view of an alternative embodiment of the invented panel.

FIG. 22 is a partial perspective view of an alternative embodiment of the invented panel 10. Castable refractory material 58 is positioned between the primary section 12 and the secondary section 14. The refractory material 58 is also positioned in the interstitial spaces 60 between the pipes 30 that comprise the primary section 12. Thus, the layer of refractory material 58 both maintains the structural integrity of the primary section 12 and aids in securing the primary section 12 to the secondary section 14. Finally, the refractory material 58 controls and limits removal of heat from the interior of the furnace.

In operation, the invented water-cooled panels 10 are repaired by the steps of first shutting down the furnace during a scheduled repair period and then disconnecting the fluid introducing and removing means from the panel 10. The primary section 12 is removed from its position adjacent the secondary section 14 and repaired. Repair of the primary section 12 may also involve replacing damaged critical components. After the primary section 12 is repaired, it is repositioned adjacent the secondary section 14. Finally, the fluid introducing and removing means are reconnected to the panel 10.

If connectors are used to secure the primary section 12 to the secondary section 14 together, the step of removing the primary section 12 from its position adjacent the secondary section 14 would necessarily involve removing the connectors. Likewise, the step of repositioning the primary section 12 adjacent the secondary section 14 would require re-securing the connectors.

Summary of the Achievement of the Objects of the Invention

From the foregoing, it is readily apparent that we have invented an improved cooling system to protect the walls, roof and duct work of a metallurgical furnace from massive chemical, thermal and chemical stresses imposed upon it by the furnace. The invented system has a primary cooling system and a back-up cooling system which operates in the event the primary cooling system is damaged or leaks.

We have also invented an improved method extending the operational duration of water-cooled equipment for a metallurgical furnace by replacing or repairing only the primary section of a two section panel.

It is to be understood that the foregoing description and specific embodiments are merely illustrative of the best mode of the invention and the principles thereof, and that various modifications and additions may be made to the apparatus by those skilled in the art, without departing from the spirit and scope of this invention, which is therefore understood to be limited only by the scope of the appended claims.

What is claimed is:

1. A dual section fluid-cooled panel for removing heat from a metallurgical furnace or a gas evacuation system, comprising:

a primary section having a chamber therein for holding a heat absorbing fluid;

a secondary section having a chamber therein for holding a heat absorbing fluid;

said secondary section being positioned exterior and adjacent to said primary section, and said secondary section being connectable to and disconnectable from said primary section; and means for introducing and removing the flow of heat absorbing fluid through either or both of said primary section and said secondary section, said means being selectively connectable to either or both of said primary section chamber and said secondary section chamber;

wherein said secondary section is operated in the event of a failure of said connectable primary section; and wherein said fluid introducing and removing means comprises a first inlet communicating with said primary section, a second inlet communicating with said secondary section, and associated valving for controlling the flow of fluid into said inlets, and a temperature sensor positioned between said primary section and said secondary section, said temperature sensor being coupled to said valving, said temperature sensor detecting failure of said primary section and upon detecting such failure directing said valving to divert heat absorbing fluid through said secondary section.

2. The panel of claim 1 wherein said primary section and said secondary section are detachably connected to form a single unit construction, said primary section and said secondary section each having at least one conduit therethrough for the flow of heat absorbing fluid, said single unit of said primary section and said secondary section is respectively attachable to additional single units of primary sections and secondary sections, with said at least one conduit therethrough each section connectable to conduits of each additional section.

3. The panel of claim 1 wherein said valving comprises a three-way valve connecting a single fluid feed to both of said inlets, said three-way valve is controlled by a plurality of automatic sensors embedded in said primary section, said automatic sensors detect failure of said primary section and direct said three-way valve to divert heat absorbing fluid from said primary section to said secondary section.

4. The panel of claim 1 wherein said valving comprises a first manual transfer valve connecting a fluid feed to said first inlet and a second manual transfer valve connecting a separate fluid feed to said second inlet.

5. The panel of claim 1 wherein said heat absorbing fluid is a liquid.

6. The panel of claim 1 wherein said heat absorbing fluid is a gas.

7. A dual section fluid-cooled panel for removing heat from a metallurgical furnace or a gas evacuation system, comprising:

a primary section having a chamber therein for holding a heat absorbing fluid;

secondary section having a chamber therein for holding a heat absorbing fluid;

said secondary section being positioned exterior and adjacent to said primary section, and said secondary section being connectable to and disconnectable from said primary section; and means for introducing and removing the flow of heat absorbing fluid through either or both of said primary section and said secondary section, said means being selectively connectable to either or both of said primary section chamber and said secondary section chamber;

wherein said secondary section is operated in the event of a failure of said connectable primary section;

said primary section and said secondary section being detachably connected to form a single unit construction, said primary section and said secondary section each having at least one conduit therethrough for the flow of heat absorbing fluid, said single unit of said primary section and said secondary section being respectively attachable to additional single units of primary sections and secondary sections, with said at least one conduit therethrough each section connectable to conduits of each additional section;

said primary section having an inner face exposed to the furnace chamber or evacuation system interior, said inner face being opposite an outer surface of said primary section, said outer face having castable refractory material attachable to said outer face, said outer surface being adjacent to an inner surface of said connectable secondary section, said castable refractory material positionable in close proximity to said at least one conduit of said primary section.

8. The panel of claim 7 wherein said primary section chamber and said secondary section chamber contains fluid passageways formed of at least one of pipes, plates, angles, tubes, and channels in each of said chambers, said fluid passageways are interconnected to allow fluid transfer from said primary section chamber to said secondary section chamber whereby when said primary section chamber is damaged, said fluid transfer occurs without disconnection of said primary section chamber from said secondary section chamber.

9. The panel of claim 7 wherein said primary section chamber is formed of at least one cooling pipe having multiple axially arranged pipes connectable by U-shaped elbows to form a continuous pipe system.

10. The panel of claim 7 wherein said primary section chamber includes means for spray cooling a fluid against said inner surface of said primary section.

11. The panel of claim 7 wherein said inner face of said primary wall is provided with slag retention devices.

12. A dual section fluid-cooled panel for removing heat from a metallurgical furnace or a gas evacuation system, comprising:

a primary section having a chamber therein for holding a heat absorbing fluid;

a secondary section having a chamber therein for holding a heat absorbing fluid;

said secondary section being positioned exterior and adjacent to said primary section, said secondary section being connectable to and disconnectable from said primary section; and means for introducing and removing the flow of heat absorbing fluid through either or both of said primary section and said secondary section, said means being selectively connectable to either or both of said primary section chamber and said secondary section chamber;

wherein said secondary section is operated in the event of a failure of said connectable primary section;

said connectable secondary section having an inner surface proximate and parallel to an outer surface of a primary section, a castable refractory material being positionable between said secondary section and said primary section.

13. The panel of claim 12 wherein said secondary section chamber contains fluid passageways formed of at least one of pipes, plates, angles, tubes, and channels.

14. The panel of claim 12 wherein said secondary section chamber has a plate-type configuration.

15. The panel of claim 12 wherein said secondary section chamber includes means for spray cooling a fluid against said inner surface of said secondary section.

16. A dual section water-cooled panel for a metallurgical furnace or a gas evacuation system comprising:

a primary wall having fluid cooling passageways therein and having a face for exposure to heat;

a back-up wall connectably affixed to and disconnectable from said first wall and generally coextensive therewith, said back-up wall having fluid cooling chamber therein; and means for controlling the flow of cooling fluid independently to said primary wall and to said back-up wall with no intermingling of fluid between said walls;

said controlling means including associated valving for controlling the flow of fluid into said inlets, and a temperature sensor positioned between said primary wall and said back-up wall, said temperature sensor is coupled to said valving, said temperature sensor detects failure of said primary wall and directs said valving to divert cooling fluid through said back-up wall chamber.

17. The panel of claim 16 wherein said face of said primary wall has slag retention devices attached thereto.

* * * * *